US008281939B2

(12) United States Patent
Chen

(10) Patent No.: US 8,281,939 B2
(45) Date of Patent: Oct. 9, 2012

(54) POSITIONING RACK FOR THIN-TYPE ELECTROTHERMAL STRAPS

(76) Inventor: Shu-Lien Chen, Taichung (TW)

( * ) Notice: Subject to any disclaimer, the term of this patent is extended or adjusted under 35 U.S.C. 154(b) by 401 days.

(21) Appl. No.: 12/654,857

(22) Filed: Jan. 6, 2010

(65) Prior Publication Data

US 2010/0108663 A1 May 6, 2010

Related U.S. Application Data

(63) Continuation-in-part of application No. 11/655,939, filed on Jan. 22, 2007, now abandoned.

(51) Int. Cl.
*A47F 7/00* (2006.01)

(52) U.S. Cl. ..... 211/13.1

(58) Field of Classification Search ..... 211/13.1, 211/61, 60.1, 183, 70.6; 206/388, 493
See application file for complete search history.

(56) References Cited

U.S. PATENT DOCUMENTS

| | | | | | |
|---|---|---|---|---|---|
| 260,450 | A * | 7/1882 | Cahoone | 118/500 |
| 1,216,700 | A * | 2/1917 | Kilkenny | 211/13.1 |
| 2,550,857 | A * | 5/1951 | Overbaugh | 248/459 |
| 3,203,748 | A * | 8/1965 | Toms | 312/249.6 |
| 4,027,799 | A * | 6/1977 | Stucker | 211/13.1 |
| 4,253,576 | A * | 3/1981 | Ford et al. | 211/70 |
| 4,270,290 | A * | 6/1981 | Eckert | 40/389 |
| 4,380,296 | A * | 4/1983 | Murray et al. | 209/704 |
| 4,736,856 | A * | 4/1988 | Alneng et al. | 211/131.1 |
| 4,830,198 | A * | 5/1989 | Colquitt | 211/70.6 |
| 4,871,076 | A * | 10/1989 | Schramm | 211/189 |
| 4,938,549 | A * | 7/1990 | Potter | 312/305 |
| 5,036,985 | A * | 8/1991 | Lovik | 211/13.1 |
| 5,454,473 | A * | 10/1995 | Hennessey | 211/85.6 |
| 5,669,514 | A * | 9/1997 | Massetti | 211/70.2 |
| 6,938,766 | B1 * | 9/2005 | Lee | 206/388 |
| 7,159,728 | B2 * | 1/2007 | Smith | 211/166 |
| 2005/0194327 | A1 * | 9/2005 | Chen | 211/13.1 |
| 2006/0289368 | A1 * | 12/2006 | Abney | 211/13.1 |
| 2007/0114191 | A1 * | 5/2007 | Chen | 211/13.1 |
| 2009/0008347 | A1 * | 1/2009 | Bell | 211/61 |

* cited by examiner

*Primary Examiner* — Sarah Purol

(57) ABSTRACT

The positioning rack for electrothermo straps includes a base with multiple arms extending radially from the base and each arm is connected with a board. Two engaging members each have a neck connected to the arm and an enlarged block IS connected to the neck. Each board is made of thermal insulation material and has multiple positioning recesses defined in two sides thereof. Each board has two holes and two secure slots which communicate with the two holes respectively. The block passes through the hole and the neck is moved to be engaged with the secure slot to connect the board to the arm. At least two electrothermal straps are engaged with the positioning recesses and spirally mounted to the boards. The boards can be easily replaced without use of rivets.

3 Claims, 11 Drawing Sheets

POSITIONING RACK FOR THIN-TYPE ELECTROTHERMAL STRAPS

FIELD OF THE INVENTION

The present invention is a Continuation-In-Part application of applicant's former patent application Ser. No. 11/655,939 filed Jan. 22, 2007, now abandoned.

BACKGROUND OF THE INVENTION

A conventional heating fan generally includes a fan unit and an electrothermal strap which generate heat when electric current passes through the electrothermal strap so that the fan unit delivers the hot air from the electrothermal strap to the users.

A convention heating fan known to applicant is disclosed in FIGS. 1 to 3, and includes a rack 1 and multiple boards 2 are connected to the rack 1, wherein the rack 1 includes a circular base 102 and multiple arms 104 extend radially from the base 102. The boards 2 each are made of thermal insulation material and connected to the arms 104 by rivets which are not shown. Each board 2 has multiple separation members 204 extending therefrom so as to define positioning recesses 202 between the separation members 204. The electrothermal strap 3 is engaged with the positioning recesses 202 of the boards 2.

When connecting the boards 2 to the arms 104, the assemblers use proper tools to rivet the boards 2. However, due to the narrow gap between the arms 104, only the wider gaps between the arms 104 allows the tools to work to rivet the boards 2, the users cannot reach the tools toward the base 102. Special tools have to be used manually and the tools can easily touch the boards 2 located around and the thermal insulation material is easily broken. This restricts the efficiency of assembly of the products.

On the other hand, when the rack 1 with electrothermal straps are installed to the case of the heat or thermal fans, the boards 2 are often broken because of impact. When the separation members 204 are broken, the two adjacent electrothermal straps are easily in contact with each other and cause circuit short. If the separation members 204 are broken, the boards 2 have to be replaced, so that the users have to remove the rivets on the arms 104 and the removal of the rivets can damage the boards 2 or the electrothermal straps. It is experienced that the way that the boards 2 are connected to the arms 104 by rivets is not convenient for maintenance. Therefore, once there are some boards 2 damaged, the whole rack 1 is replaced and this wastes material and increases the cost.

The conventional rack 1 can only wrapped with one electrothermal strap in two layers, however, in order to keep the safety gaps between the electrothermal straps, the density of the electrothermal straps is limited. If a higher thermal effect is required, the size of the heat or thermal fan has to be increased and a huge size heat or thermal fan is not welcomed in the market.

The present invention intends to provide a positioning rack for connecting the electrothermal straps, wherein the boards are engaged with the arms on the rack without use of rivets.

SUMMARY OF THE INVENTION

The present invention relates to a heat generating device and comprises a rack having a base with multiple arms extending radially from the base. Each arm has two engaging members and each engaging member has a neck connected to the arm. An enlarged block is connected to the neck. Each block has multiple bosses extending from a surface facing the arm. Multiple boards made of thermal insulation material are connected to the arms and each board has multiple separation members extending from two sides thereof, and positioning recesses are defined between the separation members. Each board has two holes and two secure slots which communicate with the two holes respectively. A width of each of the secure slots is smaller than a width of the block corresponding thereto so that the block passes through the hole and the neck is moved to be engaged with the secure slot to connect the board to the arm. The bosses urge the board. At least two electrothermal straps are engaged with the positioning recesses and spirally mounted to the boards.

The primary object of the present invention is to provide a positioning rack for electrothermal straps wherein the electrothermal straps are engaged with positioning recesses in each board on the arms and the boards can be easily installed or replaced without use of rivets.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
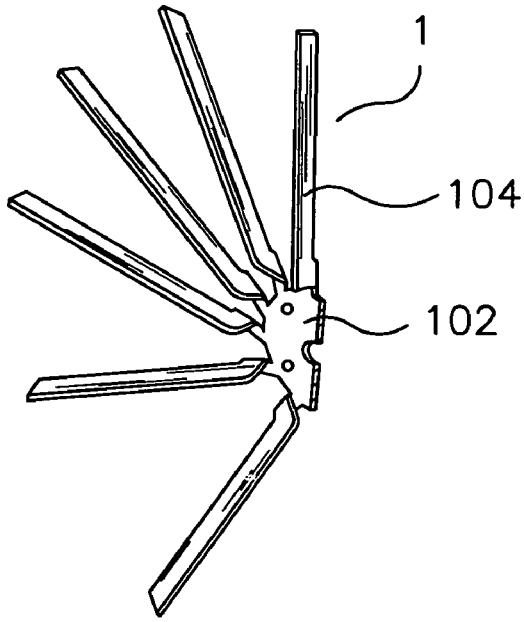
FIG. 1 PRIOR ART
FIG. 1 is a perspective view to show part of the conventional positioning rack for elelctrothermal straps.
Figure 2:
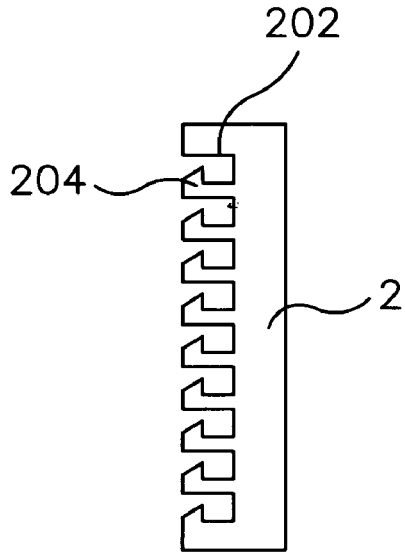
FIG. 2 PRIOR ART
FIG. 2 shows the plane view of the board of the conventional positioning rack for elelctrothermal straps.
Figure 3:
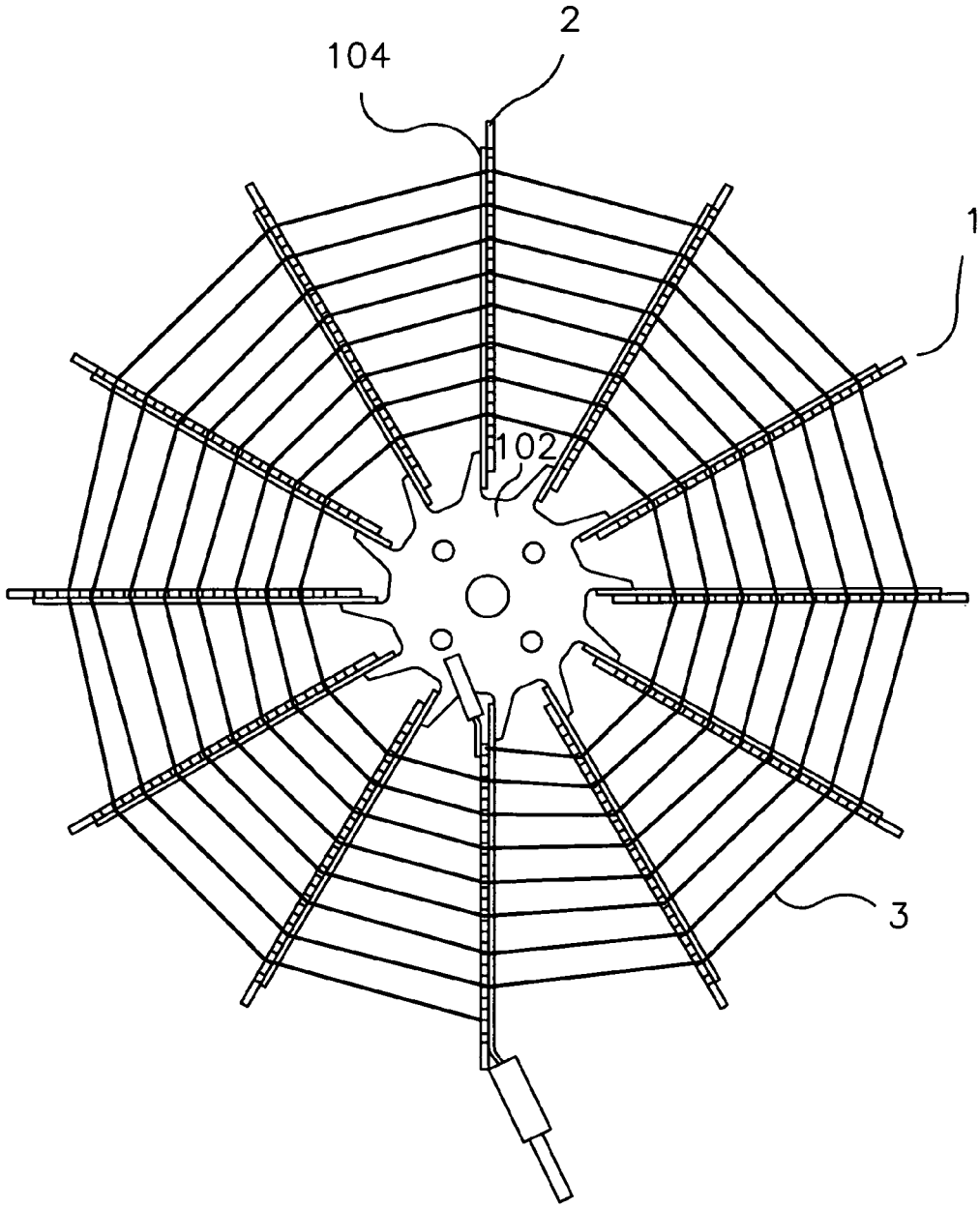
FIG. 3 PRIOR ART
FIG. 3 shows the conventional positioning rack with elelctrothermal straps connected to the boards.
Figure 4:
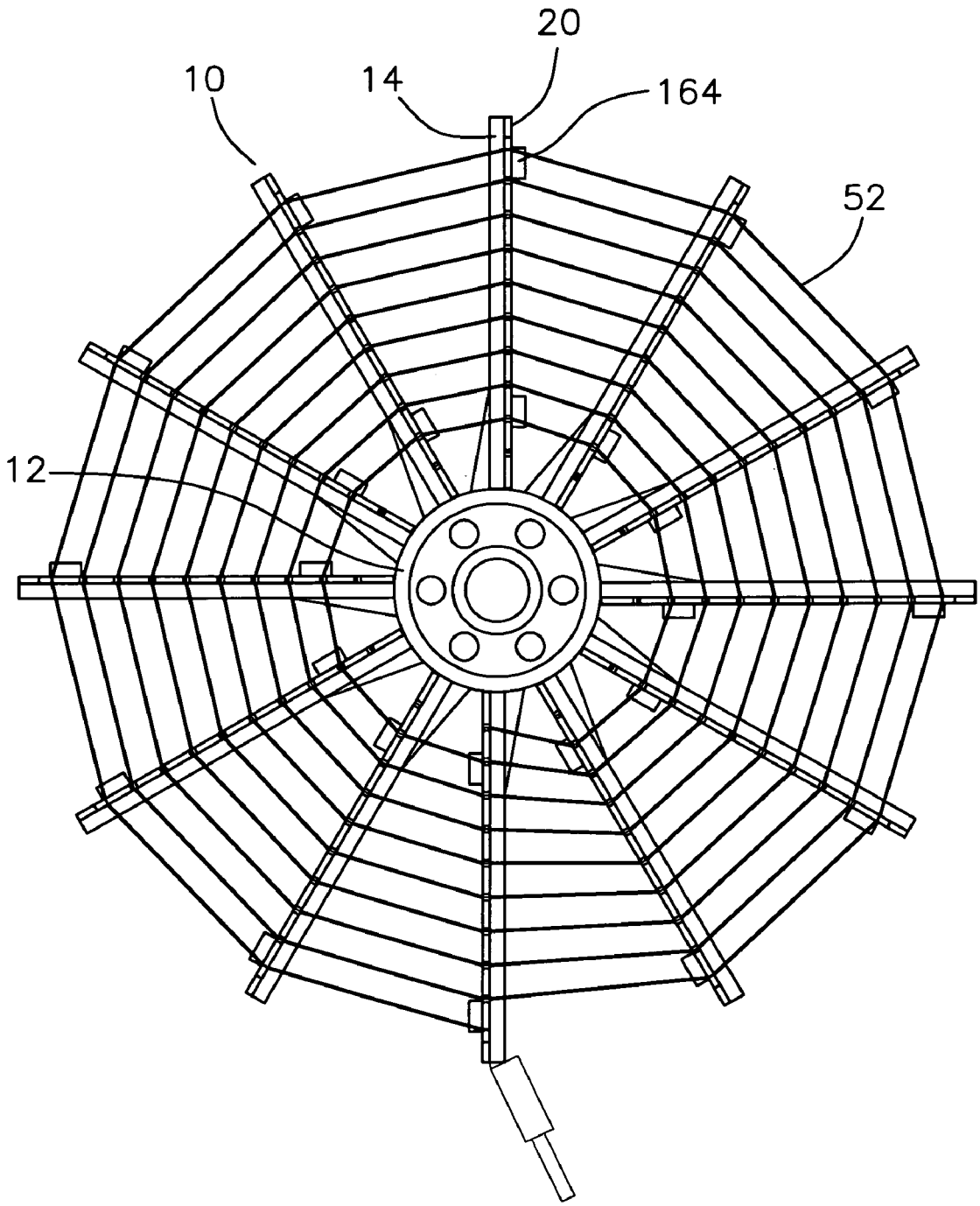
FIG. 4 shows the positioning rack for elelctrothermal straps of the present invention and one elelctrothermal strap is connected to the boards.
Figure 5:
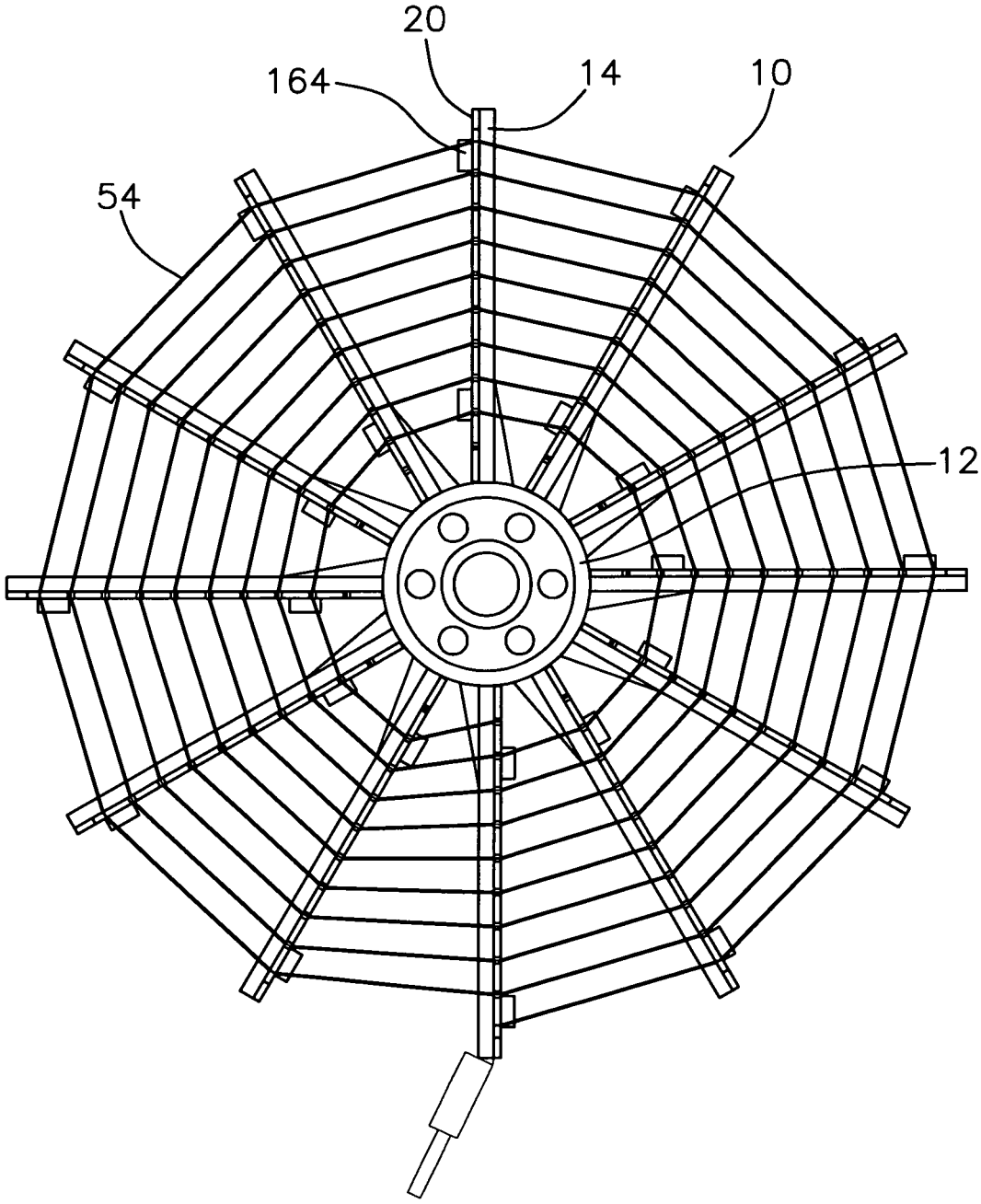
FIG. 5 shows the positioning rack for elelctrothermal straps of the present invention and the other elelctrothermal strap is connected to the boards.
Figure 6:
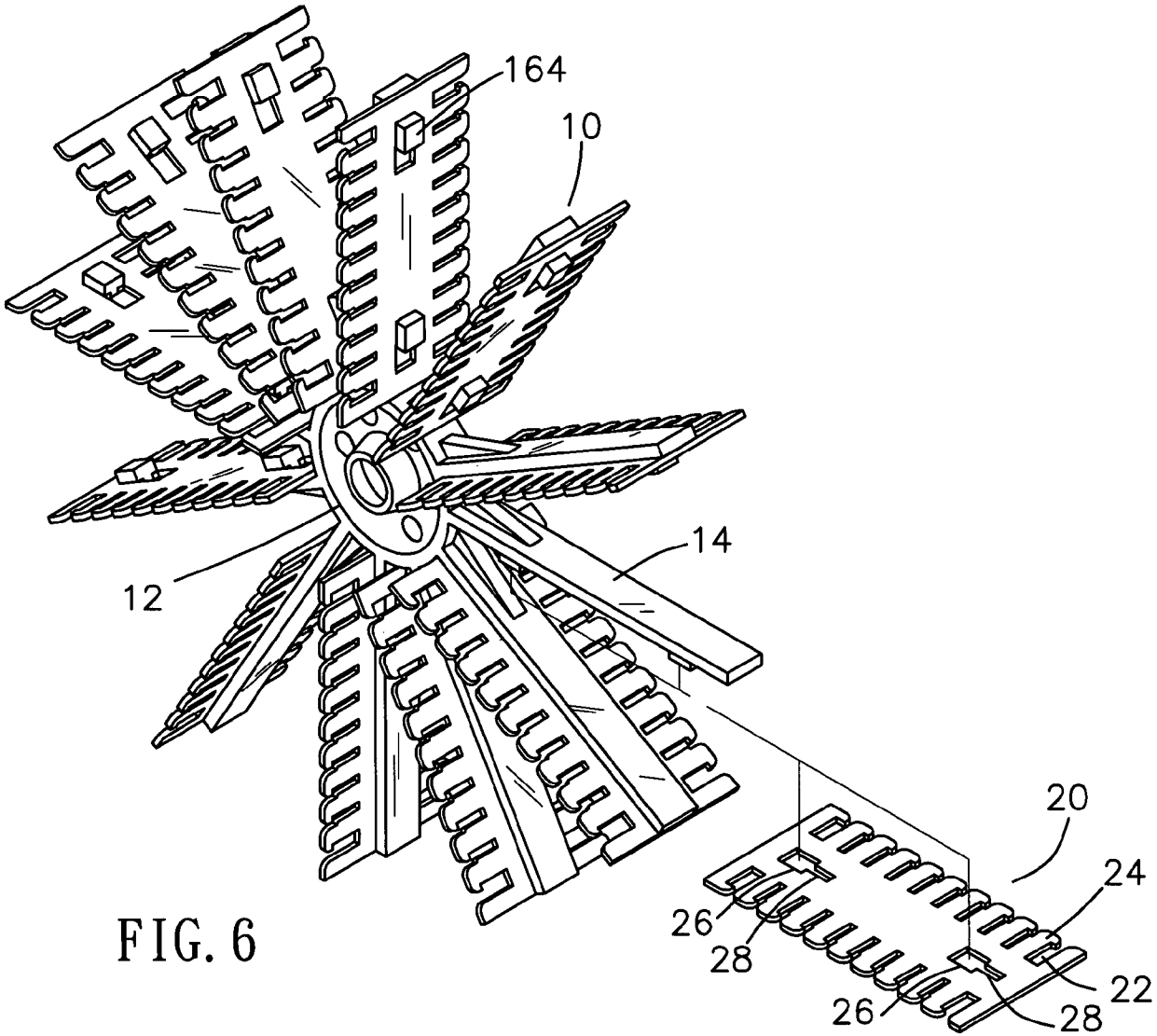
FIG. 6 is an exploded view to show the positioning rack for elelctrothermal straps of the present invention and one of the boards of the present invention.
Figure 7:
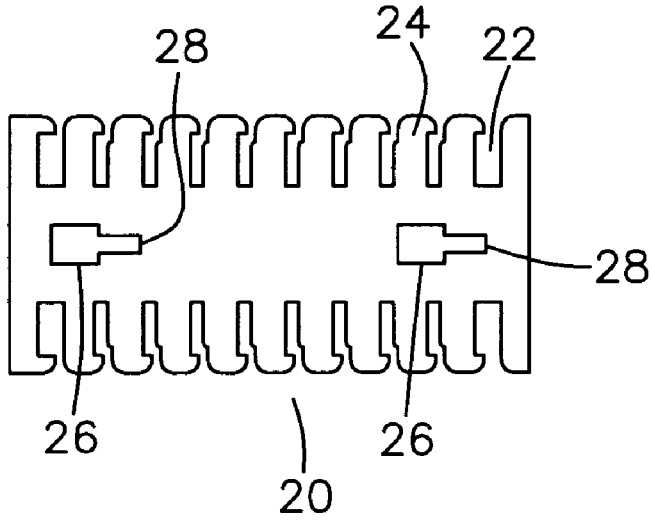
FIG. 7 is a plane view to show the board of the positioning rack for elelctrothermal straps of the present invention.
Figure 8:
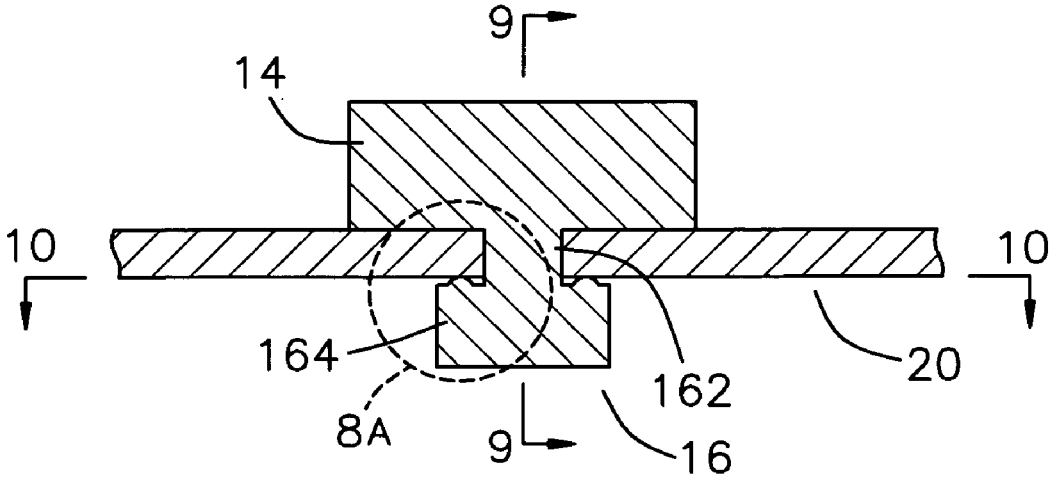
FIG. 8 is an end cross sectional view to show the engagement between the board and the arm of the positioning rack for elelctrothermal straps of the present invention.
Figure 8A:
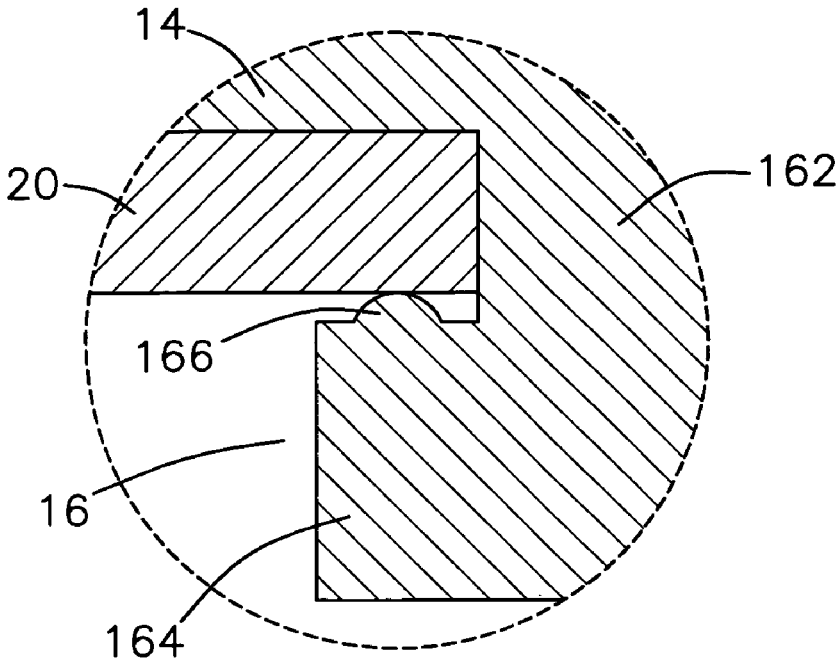
FIG. 8A is an enlarge cross sectional view to show the circle 8A of FIG. 8.
Figure 9:
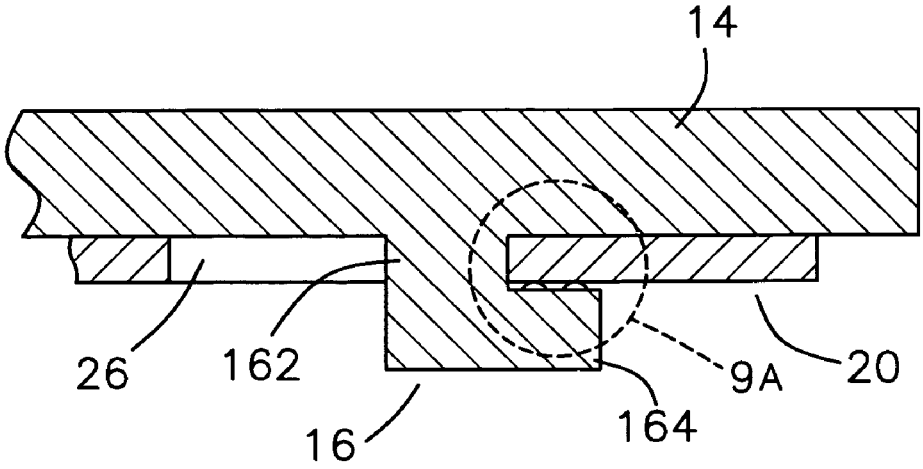
FIG. 9 is a side cross sectional view to show the engagement between the board and the arm of the positioning rack for elelctrothermal straps of the present invention.
Figure 9A:
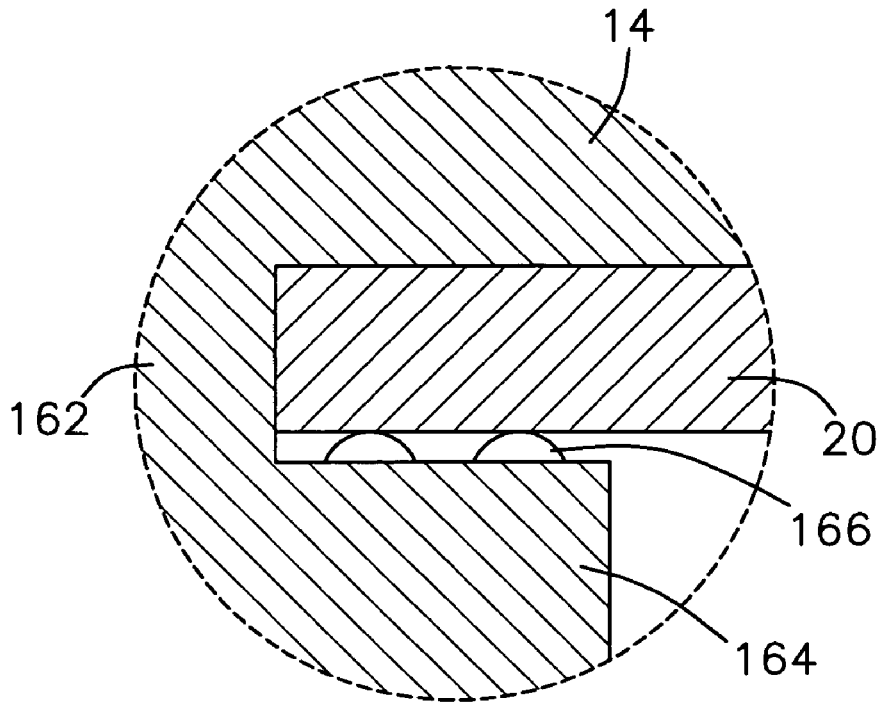
FIG. 9A is an enlarge cross sectional view to show the circle 9A of FIG. 9.
Figure 10:
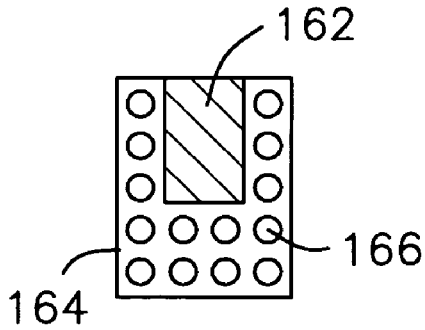
FIG. 10 shows that bosses extending from the block of the engaging member on each arm.

Referring to FIGS. 4 to 10, the positioning rack for elelctrothermal straps of the present invention comprises a rack 10 which includes a circular base 12 and multiple arms 14 extend radially from the base 12. Each arm 14 has two engaging members 16 extending from the same surface thereof and each engaging member 16 includes a neck 162 connected to the arm 14 and an enlarged block 164 connected to the neck 162. Each of the blocks 164 extends transversely relative to a longitudinal axis of the arm 14 and an axial distal end of each of the blocks 164 extends toward a distal end of the arm 14. Each block 164 has multiple bosses 166 extending from a surface facing the arm 14 as shown in FIGS. 8A, 9A, and 10.

Multiple boards 20 made of thermal insulation material are connected to the arms 14, wherein each board 20 has multiple separation members 24 extending from two sides thereof and positioning recesses 22 are defined between the separation members 24. As shown in FIG. 7, each board 20 has two holes 26 and two secure slots 28 which communicate with the two holes 26 respectively. A width of each of the secure slots 28 is smaller than a width of the block 164 corresponding thereto, and a width of the block 164 is smaller than a wide of the hole 26. Therefore, the block 164 can pass through the hole 26 and the neck 162 can be moved to be engaged with the secure slot 28 to connect the board 20 to the arm 14. The two insides of the secure slot 28 snugly contact two sides of the neck 162 and the bosses 166 urge the board 20. By this arrangement, the boards 20 can be easily installed to the arms 14 or removed from the arms 14 by the engagement of the engaging members 16 on the arms 14 and the holes 26 and the secure slots 26 in the boards 20 without use of rivets.

Two electrothermal straps 52, 54 are engaged with the positioning recesses 22 and spirally mounted to the boards 20. The first electrothermal strap 52 can be engaged with the positioning recesses 22 on one side of each board 20 and the electrothermal straps 52 is spirally connected to the boards 20 about the center of the base 12. Two ends of the electrothermal straps 52 are securely engaged with two respective positioning recesses 22 of two different boards 20. The second electrothermal strap 54 is then engaged the positioning recesses 22 on the other side of each board 20 and the electrothermal straps 54 is spirally connected to the boards 20 about the center of the base 12. Two ends of the electrothermal straps 54 are securely engaged with two respective positioning recesses 22 of two different boards 20.

Figure 11:
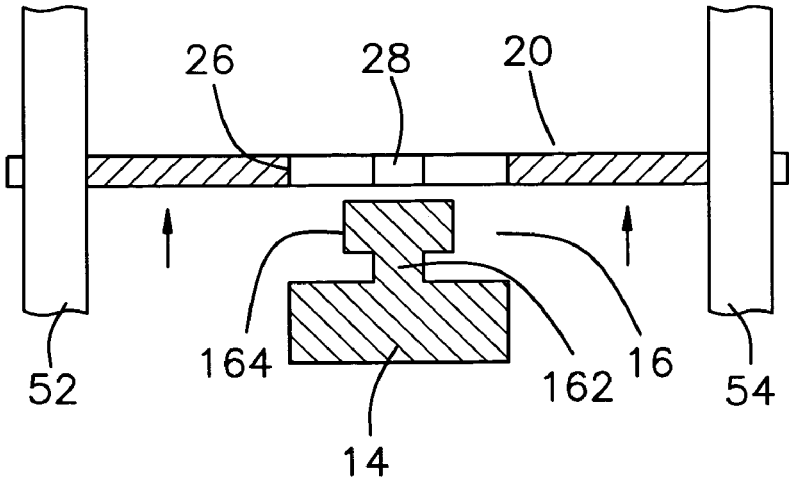
FIG. 11 shows that the board is lifted from the engaging member of the arm.
Figure 12:
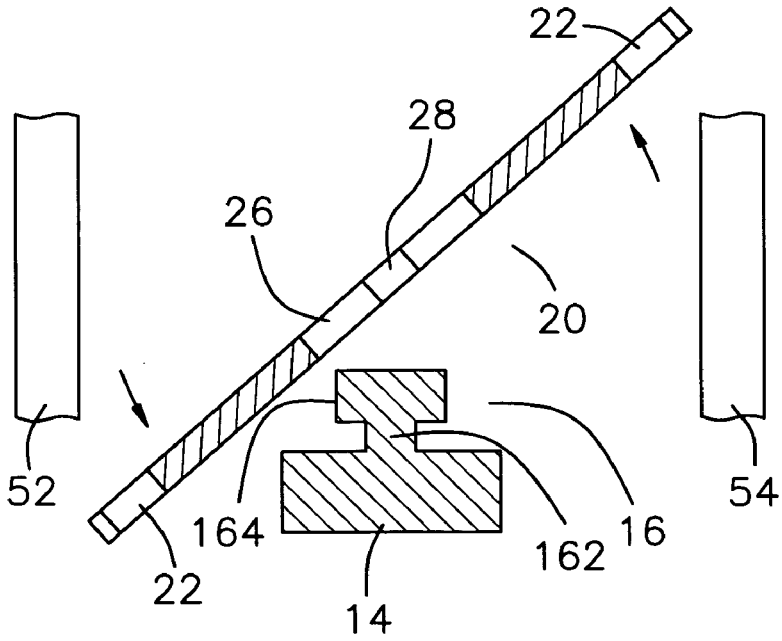
FIG. 12 shows that the board is pivoted about a center thereof to disengage from the electrothermal straps.

When one of the boards 20 is damaged or broken, the damaged or broken board 20 can be removed from the arm 14 by operation the processes in reverse sequences as mentioned above. As shown in FIGS. 6, 7, 11 and 12, when a damaged or broken board 20 needs to be replaced, the board 20 is first pushed toward the base 12 to remove the necks 162 from the secure slots 28, and the blocks 164 are located corresponding to the holes 26. The board 20 is then lifted to allow the blocks 164 to pass through the holes 26 as shown in FIG. 11, such that the board 20 is disengaged from the arm 14. The user then pivots the board 20 about a center of the board 20 as shown in FIG. 12 to le the electrothermal straps 52, 54 disengage from the positioning recesses 22. The board 20 then can be replaced with a new one. The new board 20 is connected to the arm 14 by proceeding the steps in reverse sequence. The replacement does not need any tool or rivet. Only the damaged or broken board 20 is replaced.

Figure 13:
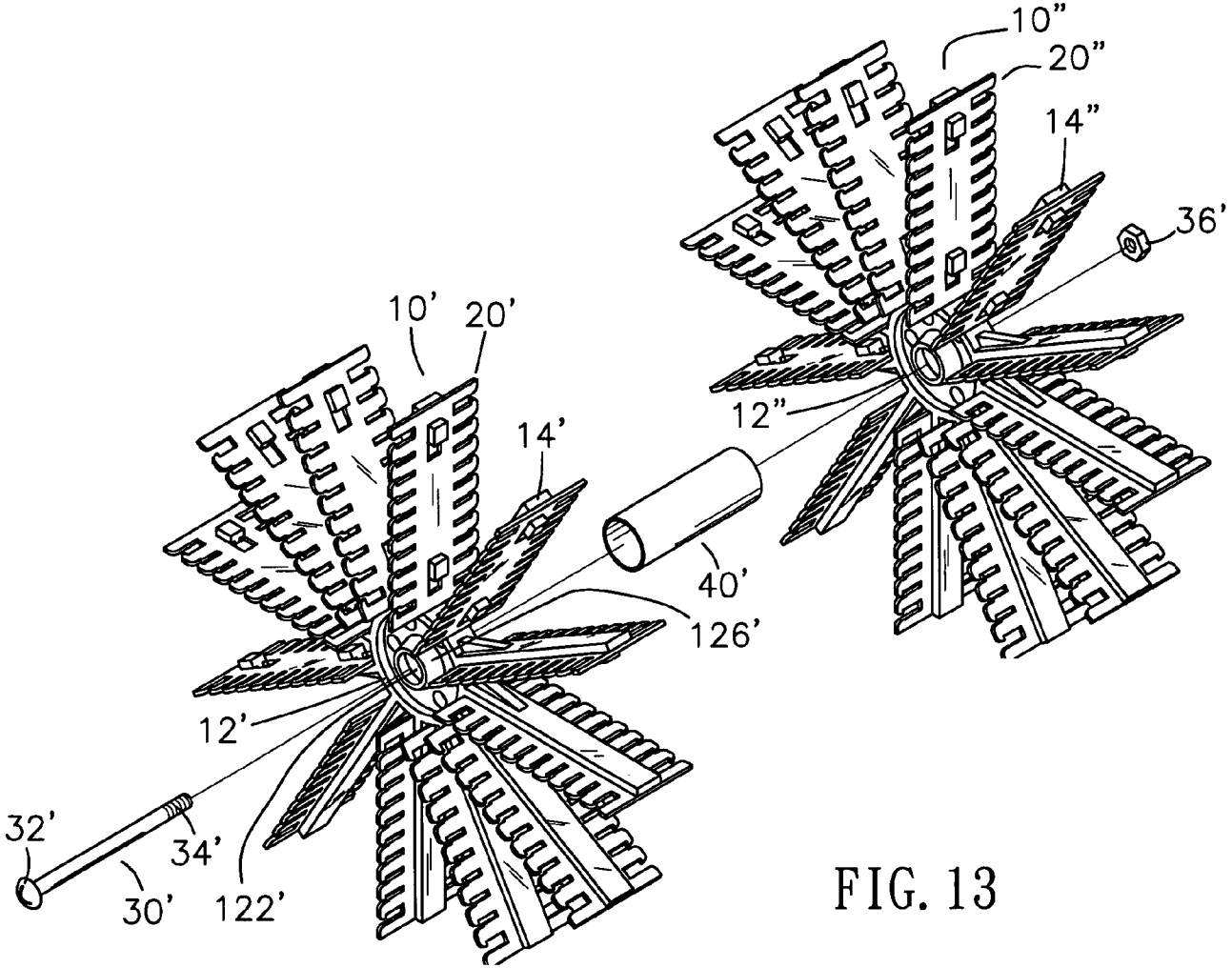
FIG. 13 shows an exploded view of another embodiment of the positioning rack for elelctrothermal straps of the present invention.
Figure 14:
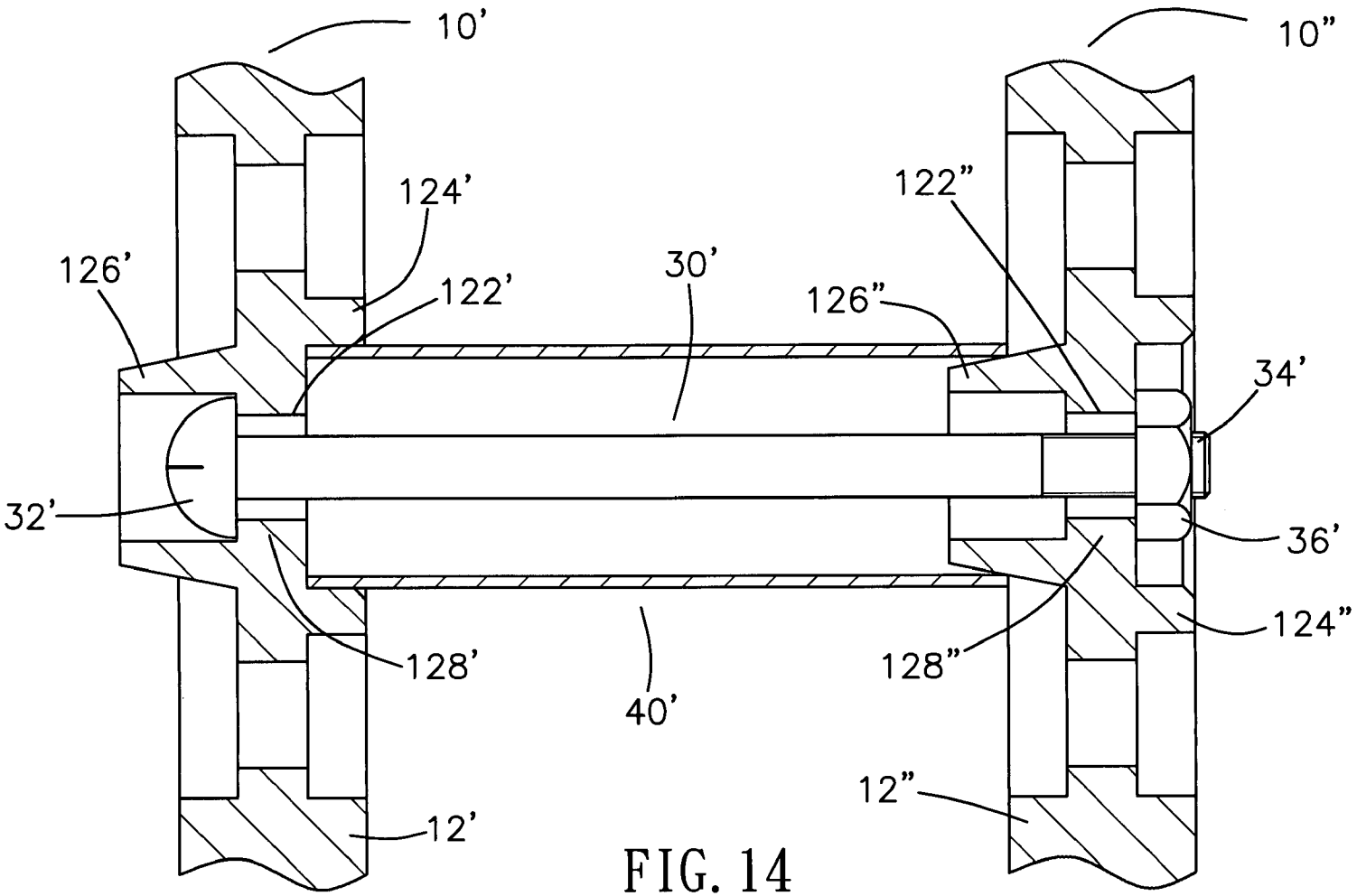
FIG. 14 is a cross sectional view to show that two positioning racks are connected to each other of the embodiment disclosed in FIG. 13.

FIGS. 13 and 14 show a second embodiment of the present invention wherein there are two racks 10', 10" each have multiple arms 14', 14" extending radially therefrom, multiple boards 20', 20" are respectively connected to the arms 14', 14", a separation tube 40' is connected between the two bases 12', 12", and a bolt 30' extends through the separation tube 40' and connects the two racks 10', 10". The two bases 12', 12" each have a passage 122'/122" defined axially therethrough and a first tube 124'/124" extends from one side of the base 12'/12". The first tube 124'/124" axially communicates with the passage 122'/122". A second tube 126'/126" extends from the other side of the base 12'/12". The second tube 126'/126" axially communicates with the passage 122'/122". A stop 128'/128" extends inward and radially from an inner periphery of the passage 122'/122". The second tube 126'/126" has a gradually reduced outer diameter from the root portion to the distal end thereof. As shown in FIG. 14, the separation tube 40' has one end mounted to the second tube 126" and the other end of the separation tube 40' is inserted into the first tube 124' and stopped by the stop 128'. The bolt 30' extends through the passage 122" and the head 32' of the bolt 30' is stopped by the stop 128', the bolt 30' includes a threaded section 34' which is threadedly connected with a nut 36'. By this way, the two racks 12', 12" are connected to each other. The electrothermal straps (not shown) are connected to the two racks 12', 12". There are more number and longer length of electrothermal straps are used so that the two racks 12', 12" can be installed in an elongate space and provide more heat air. The longer the electrothermal straps are used, the less heat that each unit length of the electrothermal straps is generated, and this means that the electrothermal straps have longer period of use of life. It is noted that the number of the racks and the separation tubes can be varied according practical use.

While we have shown and described the embodiment in accordance with the present invention, it should be clear to those skilled in the art that further embodiments may be made without departing from the scope of the present invention.

What is claimed is:

1. A heat generating device comprising:

a plurality of racks, each of rack having a base and multiple arms extending radially from the base, each arm having two engaging members and each engaging member having a neck connected to the arm and an enlarged block connected to the neck, each block having multiple bosses extending from a surface facing the arm;

multiple boards made of thermal insulation material and connected to the arms, each board having multiple separation members extending from two sides thereof and positioning recesses being defined between the separation members, each board having two holes and two secure slots which communicate with the two holes respectively, a width of each of the secure slots being smaller than a width of the block corresponding thereto so that the block passes through the hole and the neck being moved to be engaged with the secure slot to connect the board to the arm, the bosses urging the board, at least two electrothermal straps engaged with the positioning recesses and spirally mounted to the boards, wherein the base has a passage defined axially therethrough and a first tube and a second tube extend from two sides of the base respectfully, a separation tube has one end inserted into the first tube and the other end of the separation tube is mounted to the second tube of another base of the rack.

2. The device as claimed in claim 1, wherein each of the blocks extends transversely relative to a longitudinal axis of the arm and an axial distal end of each of the blocks extends toward a distal end of the arm.

3. The device as claimed in claim 1, wherein two insides of the secure slot snugly contact two sides of the neck.

* * * * *